US005740912A

United States Patent [19]

Chen

[11] Patent Number: 5,740,912

[45] Date of Patent: Apr. 21, 1998

[54] CONTAINER FOR HOLDING FOOD, CANDIES AND THE LIKE

[76] Inventor: Chin-Sheng Chen, 171, Sue Koo Road, Sung Kang Hsiang, Changhua Hsien, Taiwan

[21] Appl. No.: 824,193

[22] Filed: Mar. 25, 1997

[30] Foreign Application Priority Data

Oct. 14, 1996 [TW] Taiwan ..... 85215698

[51] Int. Cl.[6] ..... B65D 85/00

[52] U.S. Cl. ..... 206/457; 206/486; 426/110; 428/17

[58] Field of Search ..... 206/457, 458, 206/486, 487, 488; 426/106, 110; 428/15, 17

[56] References Cited

U.S. PATENT DOCUMENTS

| | | | |
|---|---|---|---|
| 1,533,131 | 4/1925 | Muller | 206/457 |
| 1,617,844 | 2/1927 | Grunberg | 206/457 |
| 2,204,037 | 6/1940 | Fernbach | 206/457 |
| 4,978,019 | 12/1990 | Maroudas et al. | 206/457 |
| 5,090,569 | 2/1992 | Nissen et al. | 206/457 |
| 5,427,244 | 6/1995 | Ikeguchi | 206/457 |

*Primary Examiner*—Jacob K. Ackun
*Assistant Examiner*—Luan K. Bui
*Attorney, Agent, or Firm*—Bacon & Thomas

[57] ABSTRACT

A food container is shaped like a flower and composed of a petaled cup, a receptacle, and a stem. The petaled cup is intended to hold food, candies, etc. and is provided with a connection rod which is fastened at one end thereof with the underside of the bottom of the petaled cup. The receptacle has a through hole and is joined with the petaled cup such that the petaled cup is received in the receptacle, and that the connection rod of the petaled cup is put through the through hole of the recetpacle, and further that petaled cup anf the receptacle are secured together by the stem, which is fastened at the top end thereof with the connection rod of the petaled cup.

5 Claims, 3 Drawing Sheets

CONTAINER FOR HOLDING FOOD, CANDIES AND THE LIKE

FIELD OF THE INVENTION

The present invention relates generally to a food container, and more particularly to the food container which can be also used as a decorative item.

BACKGROUND OF THE INVENTION

The food items are generally presented in attractive and versatile manners in a dinner party. As a result, a variety of food containers must be used for such an occasion. Generally speaking, the conventional food containers are rather montonous in design at best and can not be used for decorative purposes when they are not used to hold the food.

SUMMARY OF THE INVENTION

The primary objective of the present inention is to provide a food container which can be also used as a decorative item.

In keeping with the principle of the present invention, the foregoing objective of the present invention is attained by a food container, which is similar in profile to a flower and is composed of a petaled cup, a receptacle, and a stem. The petaled cup is intended to hold food, candies and the like and is provided at the center of the underside thereof with a connection rod. The petaled cup is provided along the rim thereof with a plurality of extensions for covering or wrapping the food or candy contained in the cup. The receptacle is provided at the center of the bottom thereof with a connection hole of size permitting the connection rod of the petaled cup to pass therethrough. The petaled cup and the receptacle are joined together such that the connection rod of the petaled cup to pass therethorugh. The petaled cup and the receptacle are joined together such that the connection rod of the petaled cup is engaged securely with the upper end of the stem via the connection hole of the receptacle.

The foregoing objective, features, functions and advantages of the present invention will be more readily understood upon a thoughtful deliberation of the following detailed description of the embodiments of the present invention in conjunction with the accompanying drawings.

DETAILED DESCRIPTION OF THE EMBODIMENTS

Figure 1:
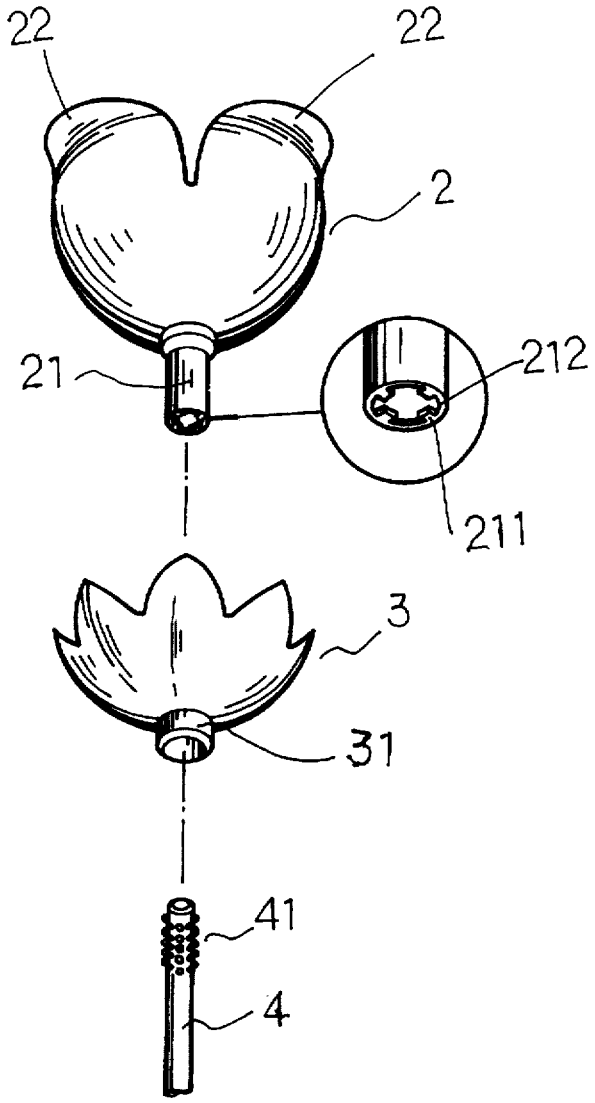
FIG. 1 shows an exploded view of a first preferred embodiment of the present invention.
Figure 2:
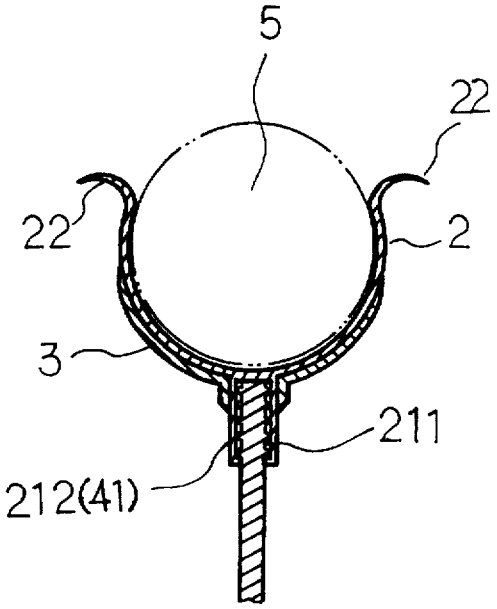
FIG. 2 shows a longitudinal sectional view of the present invention in combination.
Figure 3:
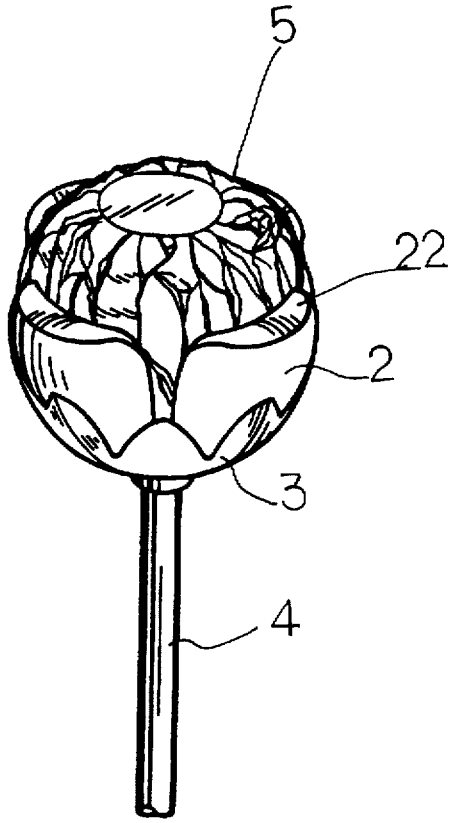
FIG. 3 shows a schematic view of the present invention at work.

As illustrated in FIGS. 1–3, a food holder embodied in the present invention is composed of a petaled cup 2, a receptacle 3, and a stem 4.

The petaled cup 2 is made integrally and provided at the center of the underside of the bottom thereof with a connection rod 21 of a hollow construction. The connection rod 21 is provided in the inner wall thereof with a plurality of connection projections 211 and connection recesses 212. The petaled cup 2 is further provided along the rim thereof with a plurality of extensions 22 which are intended for use in covering or wrapping the food 5 contained in the cup.

The receptacle 3 has a connection hole 31 located at the center of the bottom thereof. The petaled cup 2 is joined with the receptacle 3 such that the lower portion of the petaled cup 2 is received in the receptacle 3, and that the connection rod 21 of the petaled cup 2 is put through the connection hole 31 of the receptacle 3.

The stem 4 is provided on the other surface of the upper end thereof with a plurality of engagement projections 41 engageable with the connection recesses 212 of the connection rod 21 of the petaled cup 2. The petaled cup 2 and the receptacle 3 are joined together securely by the stem 4 which is engaged with the connection rod 21 of the petaled cup 2 via the connection hole 31 of the receptacle 3.

Figure 4:
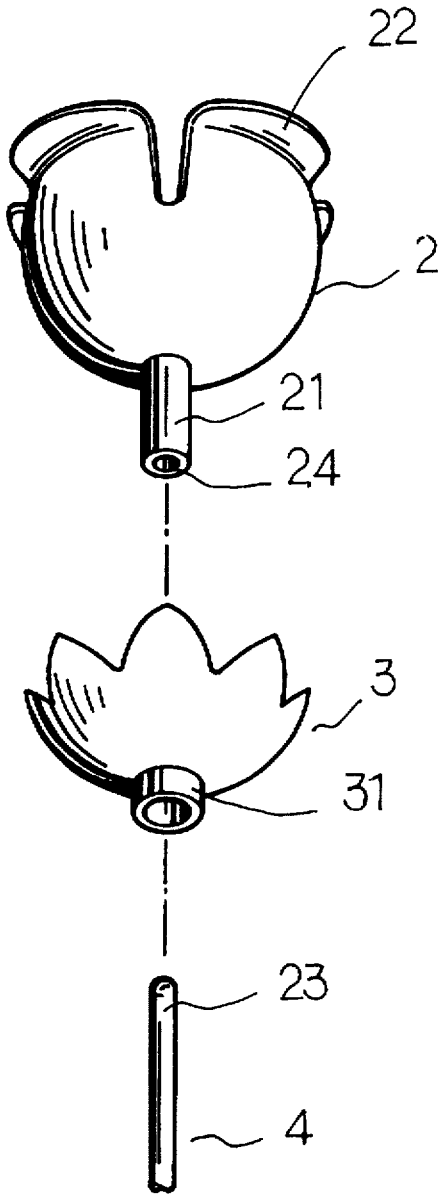
FIG. 4 shows an exploded view of a second preferred embodiment of the present invention.

The embodiment described above is to be regarded in all respects as being merely illustrative and not restrictive. Accordingly, the present invention may be embodied in other specific forms without deviating from the spirit thereof. For example, the connection rod 21 of the petaled cup 2 of the present invention may be provided with a smooth hole 24, as illustrated in FIG. 4. In the meantime, the stem 4 of the present invention may be devoid of the engagement projections 41, as shown in FIG. 4. The smooth hole 24 of the connection rod 21 of the petaled cup 2 has an inner diameter slightly greater than the outer diameter 23 of the stem 4 so as to enable the uppper end of the stem 4 to be inserted into the smooth hole 24 of the petaled cup 2. In addition, the petaled cup 2 of the present inventioin may have any shape. The present ionvention is therefore to be limited only by the scopes of the hereinafter appended claims.

What is claimed is:

1. A food container comprising:

a main body having a capacity for holding a predetermined amount of food, said main body futher having a hollow connection rod which is fastened at one end thereof with an underside of a botttom of said main body;

a receptacle having a through hole of a size permitting said connection rod of said main body to pass therethrough when main body is received in said receptacle; and a stem provided at one end thereof with means for fastening said stem with said connection rod of said main body via said through hole of said receptacle such that said main body and said receptacle are joined together securely.

2. The food container as defined on claim 1, wherein said main body is made integrally.

3. The food container as defined in claimed 1, wherein said main body is shaped like a bowl and provided with an open top and a rim having a plurality of extension portions intended for covering or wrapping the food contained in said main body.

4. The food container as definedin claim 1, wherein said hollow connection rod of said main body has a hollow interior provided with a toothed inner wall; and wherein said fastening means of said stem is a toothed portion engageable with said toothed inner wall of said connection rod of said main body.

5. The food container as defined in claim 1, wherein said hollow connection rod of said main body has a hollow interior provided with a smooth inner wall; and wherein said stem is provided with a smooth outer diameter and engageable with said connection rod of said main body by inserting an upper end portion of said stem into said hollow interior of said connection rod.

* * * * *